US006638376B2

(12) United States Patent
Hasegawa et al.

(10) Patent No.: US 6,638,376 B2
(45) Date of Patent: Oct. 28, 2003

(54) ALUMINUM ALLOY PIPING MATERIAL HAVING AN EXCELLENT CORROSION RESISTANCE AND WORKABILITY

(75) Inventors: Yoshiharu Hasegawa, Obu (JP); Haruhiko Miyachi, Okazaki (JP); Hirokazu Tanaka, Tajimi (JP); Yoshifusa Shoji, Nagoya (JP); Takahiro Koyama, Nagoya (JP); Toshihiko Fukuda, Nagoya (JP)

(73) Assignees: Denso Corporation, Kariya (JP); Sumitomo Light Metal Industries, Ltd., Tokyo (JP)

( * ) Notice: Subject to any disclaimer, the term of this patent is extended or adjusted under 35 U.S.C. 154(b) by 28 days.

(21) Appl. No.: 09/952,211

(22) Filed: Sep. 14, 2001

(65) Prior Publication Data

US 2002/0071782 A1 Jun. 13, 2002

(30) Foreign Application Priority Data

Oct. 2, 2000 (JP) ..... 2000-301970
Jun. 12, 2001 (JP) ..... 2000-177274

(51) Int. Cl.[7] ..... C22C 21/00

(52) U.S. Cl. ..... 148/437; 420/548; 420/551; 420/553

(58) Field of Search ..... 148/437, 415; 420/548, 550, 551, 553; C22C 21/00

(56) References Cited

U.S. PATENT DOCUMENTS 5,554,234 A * 9/1996 Takeuchi et al. ..... 148/551

OTHER PUBLICATIONS

"ASM Handbook: vol. 2 Properties and Selection: Nonferrous Alloys and Special–Purpose Materials", ASM International, 1990, pp 17–21, 56–57.*

* cited by examiner

*Primary Examiner*—George Wyszomierski
*Assistant Examiner*—Janelle Combs-Morillo
(74) *Attorney, Agent, or Firm*—Flynn, Thiel, Boutell & Tanis, P.C.

(57) ABSTRACT

An aluminum alloy piping material exhibiting good corrosion resistance and having an excellent workability, such as bulge formation capability at the pipe ends. The aluminum alloy piping material is suitably used for pipes connecting automotive radiators and heaters or pipes connecting evaporators, condensers, and compressors. The aluminum alloy material is formed from an aluminum alloy which contains 0.3–1.5% of Mn, 0.20% or less of Cu, 0.06–0.30% of Ti, 0.01–0.20% of Fe, and 0.01–0.20% of Si, with the balance being Al and impurities, wherein, among Si compounds, Fe compounds, and Mn compounds present in the matrix, the number of compounds with a particle diameter of 0.5 $\mu$m or more is $2\times10^4$ or less per $mm^2$. The aluminum alloy piping material may further comprise 0.4% or less of Mg.

12 Claims, No Drawings

ALUMINUM ALLOY PIPING MATERIAL HAVING AN EXCELLENT CORROSION RESISTANCE AND WORKABILITY

BACKGROUND OF THE INVENTION

1. Field of the Invention

The present invention relates to an aluminum alloy piping material. More particularly, the present invention relates to an aluminum alloy piping material having an excellent corrosion resistance and workability, which is suitably used for pipes connecting automotive radiators and heaters or pipes connecting evaporators, condensers, and compressors.

2. Description of Background Art

Pipes used for passages connecting automotive radiators and heaters or passages connecting evaporators, condensers, and compressors are provided with a bulge at the pipe ends, and connected to radiators, heaters, evaporators, condensers, or compressors. Pipes connected to radiators or the like are connected to a rubber hose and fastened using a metal band. As the piping material, a single pipe consisting of an Al—Mn alloy such as a 3003 alloy, and a two-layered or three-layered clad pipe consisting of an Al—Mn alloy as a core material and an Al—Zn alloy sacrificial anode material such as a 7072 alloy clad on the core material have conventionally been used.

In the case where the Al—Mn alloy piping material is used under a severe environment, pitting corrosion or intergranular corrosion tends to occur. When the Al—Mn alloy piping material is connected to a rubber hose, crevice corrosion occurs in the piping material at the inner side of the rubber hose, specifically, the outer side of the piping material. Use of a clad pipe prevents the occurrence of pitting corrosion or crevice corrosion. However, this significantly increases costs.

In order to solve the above problem, Japanese Patent Application Laid-open No. 4-285139 proposes a piping material exhibiting improved crevice corrosion resistance, in which Cu and Ti are added to an Al—Mn alloy and the Fe content and the Si content are limited within a specific range. This piping material has good properties under various use conditions. However, this piping material may exhibit insufficient workability during bulge formation of the pipe ends when used as a pipe. Moreover, this piping material has a problem with corrosion resistance when allowed to stand under a severe corrosive environment.

SUMMARY OF THE INVENTION

The present inventors have examined the above problems of the Al—Mn alloy piping material relating to a decrease in workability and corrosion resistance. As a result, the present inventors have found that a decrease in the corrosion resistance is caused by microgalvanic corrosion occurring between an alloy matrix and various intermetallic compounds present in the matrix. The present inventors have also found that workability at the pipe ends is affected by the distribution state of the intermetallic compounds.

The present invention has been achieved as a result of further experiments and studies on the Al—Mn alloy piping material based on the above findings. Accordingly, an object of the present invention is to provide an aluminum alloy piping material exhibiting good corrosion resistance even under a severe corrosive environment and having an excellent workability, such as bulge formation capability at the pipe ends.

One aspect of the present invention provides an aluminum alloy piping material having an excellent corrosion resistance and workability, comprising an aluminum alloy which comprises 0.3–1.5% of Mn, 0.20% or less of Cu, 0.06–0.30% of Ti, 0.01–0.20% of Fe, and 0.01–0.20% of Si, with the balance consisting of Al and impurities, wherein, among Si compounds, Fe compounds, and Mn compounds present in the matrix, the number of compounds with a particle diameter of 0.5 $\mu$m or more is $2\times10^{4}$ or less per $mm^2$.

In this aluminum alloy piping material having an excellent corrosion resistance and workability, the aluminum alloy may further comprise 0.4% or less of Mg.

In the above aluminum alloy piping material having an excellent corrosion resistance and workability, the aluminum alloy may further comprise at least one of 0.01–0.2% of Cr and 0.01–0.2% of Zr.

In the above aluminum alloy piping material having an excellent corrosion resistance and workability, the Cu content in the aluminum alloy may be 0.05–0.10%.

In the above aluminum alloy piping material having an excellent corrosion resistance and workability, the Fe content in the aluminum alloy may be 0.01–0.09%.

In the above aluminum alloy piping material having an excellent corrosion resistance and workability, the number of compounds with a particle diameter of 0.5 pm or more may be from $1\times20^{3}$ to $2\times10^{4}$ per $mm^2$.

In the above aluminum alloy piping material having an excellent corrosion resistance and workability, the tensile strength of the softened material (O material) may be 130 MPa or less.

DETAILED DESCRIPTION OF THE INVENTION AND PREFERRED EMBODIMENTS

The effects of alloy components of an aluminum alloy piping material having an excellent corrosion resistance and workability of the present invention, and reasons for the limitations of the aluminum alloy are described below. Mn increases the strength and improves corrosion resistance, in particular, pitting corrosion resistance. The Mn content is preferably 0.3–1.5%. If the Mn content is less than 0.3%, the effect may be insufficient. If the Mn content exceeds 1.5%, a large number of Mn compound particles may be formed, whereby the corrosion resistance may decrease. The Mn content is still more preferably from 0.8% or more to less than 1.2%.

Cu improves the strength of the alloy. The Cu content is preferably 0.20% or less. If the Cu content exceeds 0.20% corrosion resistance may decrease. The Cu content is still more preferably 0.05–0.10%.

Ti is separately distributed in a high-concentration area and a low-concentration area. These areas are alternately layered in the direction of the thickness. The low-concentration area is preferentially corroded rather than the high-concentration area, thereby forming corrosion layers. This prevents the corrosion from proceeding in the direction of the thickness, thereby improving pitting corrosion resistance, intergranular corrosion resistance, and crevice corrosion resistance of the material. The Ti content is preferably 0.06–0.30%. If the Ti content is less than 0.06%, the effect may be insufficient. If the Ti content exceeds 0.30%, giant compounds may be produced during casting, thereby decreasing workability. As a result, a sound piping material cannot be obtained. The Ti content is still more preferably 0.15–0.25%.

Fe decreases the grain size after extrusion or the grain size after drawing and annealing, thereby improving formability of the piping material. This prevents the occurrence of cracks or surface roughening during bulge formation or the like. The Fe content is preferably 0.01–0.20%. If the Fe content is less than 0.01%, the effect may be insufficient. If the Fe content exceeds 0.20%, a large number of Fe compound particles may be formed, whereby the corrosion resistance may decrease. The Fe content is still more preferably 0.01–0.09%.

Si decreases the grain size after extrusion or the grain size after drawing and annealing in the same manner as Fe, thereby improving formability of the piping material. This prevents the occurrence of cracks or surface roughening during bulge formation or the like. Moreover, Si forms Al—Mn—Si compounds and Al—Mn—Fe—Si compounds, thereby preventing the occurrence of penetration between tools and the material during bending, bulge formation, or the like. The Si content is preferably 0.01–0.20%. If the Si content is less than 0.01%, the effect may be insufficient. If the Si content exceeds 0.20%, a large number of Si compound particles may be formed, whereby the corrosion resistance may decrease. The Si content is still more preferably 0.01–0.10%.

Mg increases the strength and decreases the grain size. The Mg content is preferably 0.4% or less (but more than 0%). If the Mg content exceeds 0.4%, extrusion capability and corrosion resistance may decrease. The Mg content is still more preferably 0.20% or less.

Cr and Zr are separately distributed in a high-concentration area and a low-concentration area in the same manner as Ti. These areas are alternately layered in the direction of the thickness. The low-concentration area is preferentially corroded rather than the high-concentration area, thereby forming corrosion layers. This prevents corrosion from proceeding in the direction of the thickness, thereby improving pitting corrosion resistance, intergranular corrosion resistance, and crevice corrosion resistance of the material. The Cr content and the Zr content are preferably 0.01–0.2% and 0.01–0.2%, respectively. If the Cr or Zr content is less than the lower limit, the effect may be insufficient. If the Cr or Zr content exceeds the upper limit, giant compounds are produced during casting, thereby decreasing workability. As a result, a sound piping material cannot be obtained.

Depending upon the distribution of Si compounds (compounds containing Si such as Al—Si compounds), Fe compounds (compounds containing Fe such as Al—Fe compounds such as $FeAl_3$ and Al—Fe—Si compounds such as α-AlFeSi), and Mn compounds (compounds containing Mn such as Al—Mn compounds such as $Al_6Mn$, Al—Mn—Si compounds such as $Mn_3SiAl_2$, and Al—Mn—Fe—Si compounds such as α-AlMnFeSi), which are distributed in the alloy matrix, microgalvanic corrosion may occur between the compound particles and the matrix. In order to increase the corrosion resistance by preventing the occurrence of microgalvanic corrosion, it is important to limit the number of compounds with a particle diameter (equivalent circle diameter) of 0.5 pm or more among Si compounds, Fe compounds, and Mn compound within $2\times10^4$ or less per $mm^2$.

The number of the above compounds is preferably from $1\times10^{3}$ to $2\times10^4$ per $mm^2$. Such a distribution improves corrosion resistance and improves workability due to an increased elongation. The number of the above compounds is still more preferably from $1\times10^3$ to $1\times10^4$ per $mm^2$.

The aluminum alloy piping material according to the present invention is produced by casting a molten metal of an aluminum alloy having the above composition into a billet by continuous casting (semicontinuous casting); homogenizing the resulting billet; hot extruding the billet into the shape of a pipe; and annealing the formed product. In addition, the billet formed into the shape of a pipe by hot extrusion may be further drawn before annealing.

The above distribution of Si compounds, Fe compounds, and Mn compounds is obtained by adjusting the cooling rate during continuous casting and the homogenization conditions for the billet. For example, the above distribution of the Si compounds, Fe compounds, and Mn compounds is obtained by decreasing the surface level of the molten metal in a mold during continuous casting to half or less of the usual level, or increasing the casting rate from 1.2 to 1.3 times the usual rate. It is preferable to perform homogenization at a temperature of 600° C. or more. Workability can be improved by allowing the tensile strength of the softened material (O material) after annealing to be 100–130 MPa, whereby bulge formation or the like becomes easy.

EXAMPLES

The present invention is described below by examples and comparative examples. These examples illustrate only one preferred embodiment of the present invention, which should not be construed as limiting the present invention.

Example 1

Billets (diameter: 90 mm) of aluminum alloys having a composition shown in Tables 1 and 2 were cast by semi-continuous casting, and then homogenized. The casting conditions were a temperature of 700–740° C. and a cooling rate shown in Table 1 over the entire area from the outer surface of the billet to the center thereof by adjusting the surface level of the molten metal in a mold and the casting rate. Homogenization was carried out at a temperature of 600° C. or more.

Pipes with an outer diameter of 25 mm and an inner diameter of 20 mm were prepared by hot extrusion. These pipes were drawn into an outer diameter of 15 mm and a thickness of 1.0 mm, and then subjected to final annealing. Mechanical properties and the crystal grain diameter at the circumference of the annealed pipes (test materials) were measured. According to the methods given below, the distribution of Si compounds, Fe compounds, and Mn compounds in the matrix (number of compounds with a particle diameter (equivalent circular diameter) of 0.5 μm or more per $mm^2$) was measured to evaluate bulge formation capability and corrosion resistance.

Compound distribution

The total number of compounds with a particle diameter (equivalent circular diameter) of 0.5 μm or more present within five fields of optical microstructure images (magnification: ×800, total area: 0.2 $mm^2$) was measured using an image analyzer.

Bulge formation capability

The presence or absence of surface roughening was observed after bulge formation. In the case where surface roughening was not observed, bulge formation capability was evaluated as "Good". In the case where surface roughening was observed, bulge formation capability was evaluated as "Bad".

Evaluation of corrosion resistance

Corrosion test 1:

Both ends of the pipe were connected to a rubber hose to form a circulating passage. A corrosion solution ($Cl^-$:195 ppm, $SO_4$:60 ppm, $Cu^{2+}$:1 ppm, $Fe^{3+}$:30 ppm) was allowed to circulate inside the pipe at a flow rate of 2 m/sec. A cycle consisting of heating at 88° C. for 8 hours and cooling and holding at 25° C. for 16 hours was repeated 60 times. The maximum corrosion depth was measured for each of pitting corrosion and intergranular corrosion which occurred at the inner surface of the pipe, and crevice corrosion which occurred at the inner side of the rubber hose (crevice section).

Corrosion test 2:

The outer surface of the pipe was subjected to a CASS test for 672 hours. The maximum corrosion depth of pitting corrosion which occurred at the outer surface of the pipe was measured.

The measurement and evaluation results are shown in Tables 3 and 4. As shown in Tables 3 and 4, test materials Nos. 1–35 according to the present invention showed a tensile strength of 130 MPa or less and exhibited excellent bulge formation capability due to the fine grain size. Test materials Nos. 1–35 exhibited excellent corrosion resistance with a maximum corrosion depth of 0.50 mm or less. Note that sound test materials were obtained as the test materials according to the present invention because alloy Nos. 1–35 exhibited excellent fabricability due to good extrusion capability.

TABLE 1

| Alloy | Composition (mass %) Si | Fe | Mn | Cu | Ti | Mg | Cooling rate (° C./s) |
|---|---|---|---|---|---|---|---|
| 1 | 0.10 | 0.09 | 0.79 | 0.15 | 0.17 | 0.20 | 10 |
| 2 | 0.05 | 0.05 | 0.75 | 0.15 | 0.22 | — | 10 |
| 3 | 0.05 | 0.05 | 0.50 | 0.10 | 0.15 | — | 10 |
| 4 | 0.10 | 0.05 | 0.90 | 0.10 | 0.10 | — | 10 |
| 5 | 0.10 | 0.15 | 0.85 | 0.06 | 0.15 | 0.10 | 10 |
| 6 | 0.10 | 0.03 | 0.85 | 0.18 | 0.15 | — | 10 |
| 7 | 0.10 | 0.03 | 0.79 | 0.15 | 0.07 | — | 10 |
| 8 | 0.10 | 0.03 | 0.80 | 0.15 | 0.28 | — | 10 |
| 9 | 0.15 | 0.02 | 0.78 | 0.15 | 0.15 | 0.20 | 10 |
| 10 | 0.05 | 0.18 | 0.80 | 0.15 | 0.20 | — | 10 |
| 11 | 0.02 | 0.12 | 0.77 | 0.15 | 0.18 | 0.20 | 10 |

TABLE 1-continued

| Alloy | Composition (mass %) Si | Fe | Mn | Cu | Ti | Mg | Cooling rate (° C./s) |
|---|---|---|---|---|---|---|---|
| 12 | 0.18 | 0.05 | 0.79 | 0.15 | 0.17 | — | 10 |
| 13 | 0.10 | 0.05 | 0.60 | 0.06 | 0.15 | 0.38 | 10 |
| 14 | 0.08 | 0.09 | 0.62 | 0.07 | 0.20 | — | 10 |
| 15 | 0.07 | 0.08 | 0.78 | 0.07 | 0.20 | — | 10 |
| 16 | 0.08 | 0.09 | 0.79 | 0.10 | 0.24 | — | 10 |
| 17 | 0.09 | 0.08 | 0.77 | 0.07 | 0.16 | — | 10 |
| 18 | 0.08 | 0.08 | 0.78 | 0.08 | 0.20 | — | 10 |
| 19 | 0.08 | 0.08 | 0.78 | 0.07 | 0.20 | — | 10 |
| 20 | 0.09 | 0.08 | 0.78 | 0.08 | 0.20 | 0.15 | 10 |

TABLE 2

| Alloy | Composition (mass %) Si | Fe | Mn | Cu | Ti | Mg | Other | Cooling rate (° C./s) |
|---|---|---|---|---|---|---|---|---|
| 21 | 0.10 | 0.09 | 0.75 | 0.15 | 0.17 | 0.20 | Cr0.03 | 10 |
| 22 | 0.10 | 0.09 | 0.75 | 0.15 | 0.17 | 0.20 | Zr0.03 | 10 |
| 23 | 0.10 | 0.09 | 0.75 | 0.15 | 0.17 | 0.20 | Cr0.18 | 10 |
| 24 | 0.10 | 0.08 | 0.75 | 0.15 | 0.17 | 0.20 | Zr0.18 | 10 |
| 25 | 0.10 | 0.08 | 0.79 | 0.15 | 0.17 | 0.20 | | 10 |
| 26 | 0.05 | 0.05 | 0.79 | 0.15 | 0.17 | — | | 20 |
| 27 | 0.05 | 0.05 | 1.00 | 0.07 | 0.18 | — | | 10 |
| 28 | 0.10 | 0.08 | 0.40 | 0.12 | 0.20 | — | | 10 |
| 29 | 0.05 | 0.09 | 1.40 | 0.01 | 0.17 | — | | 10 |
| 30 | 0.10 | 0.08 | 0.80 | 0.07 | 0.17 | — | | 10 |
| 31 | 0.10 | 0.09 | 1.15 | 0.04 | 0.17 | — | | 10 |
| 32 | 0.05 | 0.07 | 1.05 | 0.00 | 0.22 | — | | 10 |
| 33 | 0.10 | 0.06 | 0.95 | 0.18 | 0.15 | — | | 10 |
| 34 | 0.09 | 0.08 | 1.00 | 0.05 | 0.17 | — | | 10 |
| 35 | 0.10 | 0.06 | 1.10 | 0.10 | 0.17 | — | | 10 |

TABLE 3

| Test material | Alloy | Mechanical property: Tensile strength (MPa) | Elongation (%) | Crystal grain size (μm) | Number of compounds with particle diameter of 0.5 μm or more (per mm²) | Bulge formation capability | Maximum corrosion depth (mm): Corrosion test 1: Inner surface | Corrosion test 1: Crevice | Corrosion test 2: Outer surface |
|---|---|---|---|---|---|---|---|---|---|
| 1 | 1 | 121 | 33 | 100 | $8 \times 10^3$ | Good | 0.20 | 0.30 | 0.20 |
| 2 | 2 | 110 | 35 | 150 | $1 \times 10^4$ | Good | 0.15 | 0.30 | 0.15 |
| 3 | 3 | 125 | 32 | 150 | $1 \times 10^4$ | Good | 0.20 | 0.25 | 0.25 |
| 4 | 4 | 111 | 36 | 140 | $1 \times 10^4$ | Good | 0.40 | 0.45 | 0.33 |
| 5 | 5 | 105 | 42 | 130 | $9 \times 10^3$ | Good | 0.20 | 0.38 | 0.22 |
| 6 | 6 | 115 | 35 | 130 | $9 \times 10^3$ | Good | 0.40 | 0.42 | 0.30 |
| 7 | 7 | 109 | 40 | 130 | $9 \times 10^3$ | Good | 0.28 | 0.35 | 0.19 |
| 8 | 8 | 110 | 40 | 130 | $9 \times 10^3$ | Good | 0.42 | 0.42 | 0.42 |
| 9 | 9 | 120 | 32 | 100 | $8 \times 10^3$ | Good | 0.15 | 0.32 | 0.15 |
| 10 | 10 | 109 | 35 | 100 | $8 \times 10^3$ | Good | 0.45 | 0.49 | 0.37 |
| 11 | 11 | 121 | 33 | 150 | $1.5 \times 10^4$ | Good | 0.41 | 0.45 | 0.34 |
| 12 | 12 | 111 | 36 | 100 | $8 \times 10^3$ | Good | 0.40 | 0.45 | 0.33 |
| 13 | 13 | 129 | 30 | 130 | $9 \times 10^3$ | Good | 0.35 | 0.45 | 0.33 |
| 14 | 14 | 110 | 33 | 140 | $8 \times 10^3$ | Good | 0.20 | 0.30 | 0.20 |
| 15 | 15 | 112 | 32 | 145 | $8 \times 10^3$ | Good | 0.25 | 0.35 | 0.20 |
| 16 | 16 | 120 | 32 | 145 | $8 \times 10^3$ | Good | 0.30 | 0.35 | 0.30 |

TABLE 3-continued

| Test material | Alloy | Mechanical property: Tensile strength (MPa) | Mechanical property: Elongation (%) | Crystal grain size (μm) | Number of compounds with particle diameter of 0.5 μm or more (per mm²) | Bulge formation capability | Maximum corrosion depth (mm): Corrosion test 1: Inner surface | Maximum corrosion depth (mm): Corrosion test 1: Crevice | Maximum corrosion depth (mm): Corrosion test 2: Outer surface |
|---|---|---|---|---|---|---|---|---|---|
| 17 | 17 | 112 | 32 | 145 | $8 \times 10^3$ | Good | 0.25 | 0.35 | 0.20 |
| 18 | 18 | 112 | 33 | 140 | $8 \times 10^3$ | Good | 0.30 | 0.35 | 0.30 |
| 19 | 19 | 113 | 35 | 140 | $8 \times 10^3$ | Good | 0.30 | 0.35 | 0.25 |
| 20 | 20 | 114 | 34 | 140 | $8 \times 10^3$ | Good | 0.25 | 0.35 | 0.25 |

TABLE 4

| Test material | Alloy | Mechanical property: Tensile strength (MPa) | Mechanical property: Elongation (%) | Crystal grain size (μm) | Number of compounds with particle diameter of 0.5 μm or more (per mm²) | Bulge formation capability | Maximum corrosion depth (mm): Corrosion test 1: Inner surface | Maximum corrosion depth (mm): Corrosion test 1: Crevice | Maximum corrosion depth (mm): Corrosion test 2: Outer surface |
|---|---|---|---|---|---|---|---|---|---|
| 21 | 21 | 122 | 32 | 100 | $8 \times 10^3$ | Good | 0.21 | 0.32 | 0.22 |
| 22 | 22 | 120 | 33 | 100 | $8 \times 10^3$ | Good | 0.21 | 0.32 | 0.30 |
| 23 | 23 | 122 | 33 | 100 | $8 \times 10^3$ | Good | 0.44 | 0.45 | 0.40 |
| 24 | 24 | 122 | 32 | 100 | $8 \times 10^3$ | Good | 0.42 | 0.48 | 0.33 |
| 25 | 25 | 120 | 32 | 110 | $6 \times 10^3$ | Good | 0.15 | 0.20 | 0.15 |
| 26 | 26 | 110 | 35 | 170 | $6 \times 10^3$ | Good | 0.10 | 0.20 | 0.10 |
| 27 | 27 | 120 | 33 | 130 | $8 \times 10^3$ | Good | 0.20 | 0.35 | 0.15 |
| 28 | 28 | 85 | 36 | 110 | $8 \times 10^3$ | Good | 0.45 | 0.30 | 0.40 |
| 29 | 29 | 125 | 33 | 100 | $1.2 \times 10^4$ | Good | 0.25 | 0.20 | 0.10 |
| 30 | 30 | 105 | 34 | 110 | $8 \times 10^3$ | Good | 0.25 | 0.20 | 0.25 |
| 31 | 31 | 115 | 32 | 100 | $1 \times 10^4$ | Good | 0.34 | 0.20 | 0.30 |
| 32 | 32 | 107 | 33 | 120 | $8 \times 10^3$ | Good | 0.23 | 0.35 | 0.25 |
| 33 | 33 | 118 | 33 | 130 | $1 \times 10^4$ | Good | 0.40 | 0.20 | 0.47 |
| 34 | 34 | 102 | 35 | 110 | $8 \times 10^3$ | Good | 0.21 | 0.20 | 0.25 |
| 35 | 35 | 110 | 33 | 130 | $1 \times 10^4$ | Good | 0.28 | 0.20 | 0.29 |

Comparative Example 1

Billets (diameter: 90 mm) of aluminum alloys having a composition shown in Table 5 were cast by semicontinuous casting and homogenized. The casting conditions were a temperature of 700–740° C. and a cooling rate shown in Table 5 over the entire area from the outer surface of the billet to the center thereof by adjusting the surface level of the molten metal in a mold and the casting rate in the same manner as in Example 1. Homogenization was carried out at a temperature of 600° C. or more. Note that alloy No. 57 was cast at an ordinary cooling rate and homogenized at a temperature of 550° C.

Pipes with an outer diameter of 25 mm and an inner diameter of 20 mm were prepared by hot extrusion. These pipes were drawn into an outer diameter of 15 mm and a thickness of 1.0 mm, and then subjected to final annealing. Mechanical properties and the crystal grain diameter at the circumference of the annealed pipes (test materials) were measured. According to the same methods as in Example 1, the distribution of Si compounds, Fe compounds, and Mn compounds in the matrix (number of compounds with a particle diameter (equivalent circular diameter) of 0.5 μm or more per mm²) was measured to evaluate bulge formation capability and corrosion resistance. The results are shown in Table 6.

TABLE 5

| Alloy | Composition (mass %): Si | Fe | Mn | Cu | Ti | Mg | Other | Cooling rate (° C./s) |
|---|---|---|---|---|---|---|---|---|
| 36 | 0.10 | 0.10 | 0.20 | 0.10 | 0.17 | — | | 10 |
| 37 | 0.15 | 0.15 | 1.00 | 0.50 | 0.17 | — | | 10 |
| 38 | 0.15 | 0.15 | 1.00 | 0.15 | 0.02 | — | | 10 |
| 39 | 0.15 | 0.15 | 1.00 | 0.15 | 0.50 | — | | 10 |
| 40 | 0.05 | 0.00 | 0.80 | 0.15 | 0.15 | 0.20 | | 10 |
| 41 | 0.15 | 0.50 | 0.80 | 0.15 | 0.17 | — | | 20 |
| 42 | 0.00 | 0.05 | 0.78 | 0.15 | 0.16 | 0.20 | | 10 |
| 43 | 0.50 | 0.15 | 0.79 | 0.15 | 0.15 | — | | 10 |
| 44 | 0.10 | 0.10 | 0.70 | 0.20 | 0.17 | 0.60 | | 10 |
| 45 | 0.15 | 0.15 | 0.70 | 0.20 | 0.17 | 0.10 | | 10 |
| 46 | 0.05 | 0.05 | 0.70 | 0.15 | 0.17 | — | | 10 |
| 47 | 0.45 | 0.45 | 1.20 | 0.15 | 0.05 | — | | 10 |
| 48 | 0.25 | 0.25 | 1.10 | 0.15 | 0.15 | — | | 1.5 |
| 49 | 0.10 | 0.10 | 1.60 | 0.15 | 0.20 | — | Cr0.4 | 10 |
| 50 | 0.05 | 0.05 | 1.00 | 0.07 | 0.18 | — | Zr0.4 | 0.5 |

TABLE 6

| Test material | Alloy | Mechanical property: Tensile strength (MPa) | Mechanical property: Elongation (%) | Crystal grain size (μm) | Number of compounds with particle diameter of 0.5 μm or more (per mm²) | Bulge formation capability | Maximum corrosion depth (mm): Corrosion test 1: Inner surface | Maximum corrosion depth (mm): Corrosion test 1: Crevice | Maximum corrosion depth (mm): Corrosion test 2: Outer surface |
|---|---|---|---|---|---|---|---|---|---|
| 36 | 36 | 80 | 35 | 150 | $1 \times 10^4$ | Good | 0.50 | 0.45 | 0.50 |
| 37 | 37 | 142 | 25 | 100 | $3 \times 10^4$ | Bad | 0.85 | Perforation | 0.86 |
| 38 | 38 | 115 | 32 | 100 | $1 \times 10^4$ | Good | 0.70 | 0.80 | 0.68 |
| 39 | 39 | — | — | — | — | — | — | — | — |
| 40 | 40 | 121 | 35 | 350 | $1 \times 10^4$ | Bad | 0.50 | 0.47 | 0.50 |
| 41 | 41 | 110 | 33 | 50 | $5 \times 10^4$ | Good | 0.85 | 0.90 | 0.82 |
| 42 | 42 | 122 | 33 | 340 | $1 \times 10^4$ | Bad | 0.50 | 0.48 | 0.50 |
| 43 | 43 | 108 | 34 | 50 | $5 \times 10^4$ | Good | 0.85 | 0.91 | 0.85 |
| 44 | 44 | — | — | — | — | — | — | — | — |
| 45 | 45 | — | — | — | — | — | — | — | — |
| 46 | 46 | — | — | — | — | — | — | — | — |
| 47 | 47 | 110 | 33 | 100 | $4 \times 10^4$ | Good | 0.95 | 0.92 | 0.91 |
| 48 | 48 | 112 | 33 | 100 | $2.5 \times 10^4$ | Good | 0.90 | 0.89 | 0.87 |
| 49 | 49 | 130 | 30 | 90 | $4 \times 10^4$ | Good | 0.85 | 0.53 | 0.89 |
| 50 | 50 | 115 | 34 | 70 | $6 \times 10^4$ | Good | 0.95 | Perforation | 0.88 |

As shown in Table 6, test material No. 36 exhibited insufficient strength due to the low Mn content. Test material No. 49 exhibited inferior corrosion resistance since a large number of Mn compounds was formed due to the high Mn content. Test material No. 37 exhibited inferior corrosion resistance due to the high Cu content, and perforation occurred in the crevice section.

Test material No. 38 exhibited insufficient corrosion resistance due to low Ti content. In test material No. 39, giant compounds were produced during casting, thereby decreasing workability. Therefore, a sound test material could not be obtained. In test material No. 40, the grain size was increased due to low Fe content, whereby surface roughening occurred during bulge formation. In test material No. 41, a large number of Fe compounds was formed due to high Fe content, whereby the corrosion resistance decreased.

The grain size was increased in test material No. 42 due to low Si content, thereby resulting in inferior bulge formation capability. In test material No. 43, the amount of Si compounds was increased due to high Si content, whereby the corrosion resistance decreased. Test material No. 44 exhibited insufficient extrusion capability due to high Mg content, whereby a sound test material could not be obtained.

In test materials Nos. 45 and 46, giant compounds were produced during casting due to high Cr content and high Zr content, respectively, thereby impairing workability. As a result, a sound test material could not be obtained.

Test material No. 47 consisting of a conventional 3003 alloy exhibited inferior corrosion resistance. Test material No.50 exhibited inferior corrosion resistance since the number of compound particles was significantly increased due to a low cooling rate during casting, whereby perforation occurred in the corrosion test. Test material No.48 exhibited inferior corrosion resistance since a large number of compound particles was formed.

As described above, the present invention provides an aluminum alloy piping material exhibiting good corrosion resistance, even under a severe corrosive environment, and having an excellent workability, such as bulge formation capability at the pipe ends. This aluminum alloy piping material is suitably used for pipes connecting automotive radiators and heaters or pipes connecting evaporators, condensers, and compressors.

Obviously, numerous modifications and variations of the present invention are possible in light of the above teachings. It is therefore to be understood that, within the scope of the appended claims, the invention may be practiced other than as specifically described herein.

What is claimed is:

1. An aluminum alloy piping material having an excellent corrosion resistance and workability, said aluminum alloy piping material comprising an aluminum alloy consisting of, in mass %, 0.3–1.5% of Mn, 0.20% or less of Cu, 0.06–0.30% of Ti, 0.01–0.20% of Fe and 0.010–0.20% of Si, with the balance being Al and impurities, wherein among Si compounds, Fe compounds and Mn compounds present in the alloy's matrix, the number of compounds with an equivalent circle particle diameter of 0.5 μm or more is from $1\times10^3$–$2\times10^4$ per mm².

2. The aluminum alloy piping material of claim 1, wherein the Cu content is 0.05–0.10%.

3. The aluminum alloy piping material of claim 1, wherein the Fe content is 0.01–0.09%.

4. The aluminum alloy piping material of claim 1, wherein the material in a softened state has a tensile strength of 130 MPa or less.

5. An aluminum alloy piping material having an excellent corrosion resistance and workability, said aluminum alloy piping material comprising an aluminum alloy consisting of, in mass %, 0.3–1.5% of Mn, 0.20% or less of Cu, 0.06–0.30% of Ti, 0.01–0.20% of Fe, 0.01–0.20% of Si and Mg in an amount not exceeding 0.4%, with the balance being Al and impurities, wherein among Si compounds, Fe compounds and Mn compounds present in the alloy's matrix, the number of compounds with an equivalent circle particle diameter of 0.5 μm or more is from $1\times10^3$–$2\times10^4$ per mm².

6. The aluminum alloy piping material of claim 5, wherein the Cu content is 0.05–0.10%.

7. The aluminum alloy piping material of claim wherein the Fe content is 0.01–0.09%.

8. The aluminum alloy piping material of claim 5, wherein the material in a softened state has a tensile strength of 130 MPa or less.

9. An aluminum alloy piping material having an excellent corrosion resistance and workability, said aluminum alloy piping material comprising an aluminum alloy consisting of, in mass %, 0.3–1.5% of Mn, 0.20% or less of Cu, 0.06–0.30% of Ti, 0.01–0.20% of Fe, 0.01–0.20% of Si and at least one of 0.01–0.2% of Cr and 0.01–0.2% of Zr, with the balance being Al and impurities, wherein among Si compounds, Fe compounds and Mn compounds present in the alloy's matrix, the number of compounds with an equivalent circle particle diameter of 0.5 $\mu$m or more is from $1\times10^3$–$2\times10^4$ per $mm^2$.

10. The aluminum alloy piping material of claim 9, wherein the Cu content is 0.05–0.10%.

11. The aluminum alloy piping material of claim 9, wherein the Fe content is 0.01–0.09%.

12. The aluminum alloy piping material of claim 9, wherein the material in a softened state has a tensile strength of 130 MPa or less.

* * * * *